United States Patent [19]

Kondo

[11] 3,959,119

[45] May 25, 1976

[54] METHOD OF UPGRADING LOW-GRADE OILS

[75] Inventor: Masaki Kondo, Tokyo, Japan

[73] Assignee: Sumitomo Shipbuilding & Machinery Co., Ltd., Tokyo, Japan

[22] Filed: May 1, 1974

[21] Appl. No.: 465,998

[30] Foreign Application Priority Data

May 4, 1973 Japan ..... 48-49036

[52] U.S. Cl. ..... 208/127; 208/100; 208/187

[51] Int. Cl.[2] ..... C10G 9/32

[58] Field of Search ..... 208/127, 179, 187, 100

[56] References Cited

UNITED STATES PATENTS

| | | | |
|---|---|---|---|
| 2,756,195 | 7/1956 | Adams | 208/127 |
| 2,776,799 | 1/1957 | Spitz et al. | 208/127 |
| 2,885,348 | 5/1959 | Brown et al. | 208/127 |
| 3,743,593 | 7/1973 | Saxton | 208/127 |

*Primary Examiner*—Herbert Levine
*Attorney, Agent, or Firm*—Woodhams, Blanchard and Flynn

[57] ABSTRACT

A method of obtaining a refined oil product from low-grade oils containing a relatively large amount of water and/or sludge, which comprises the steps of introducing a low-grade oil directly into a fluidized bed type cracking furnace and subjecting it to thermal cracking therein, introducing the resulting efflux from said cracking furnace into a fractionation column and therein separating it into an overhead light vapor component which is removed from the top of said column and a heavy component which is recovered from the bottom of said column, cooling the overhead light vapor component and then feeding it into a gas-liquid separator to divide it into a vapor-phase stream and a liquidphase stream, and circulating a part of said liquid-phase stream to the top of the fractionation column as reflux while recovering the balance of the liquid-phase stream as the refined oil product.

5 Claims, 1 Drawing Figure

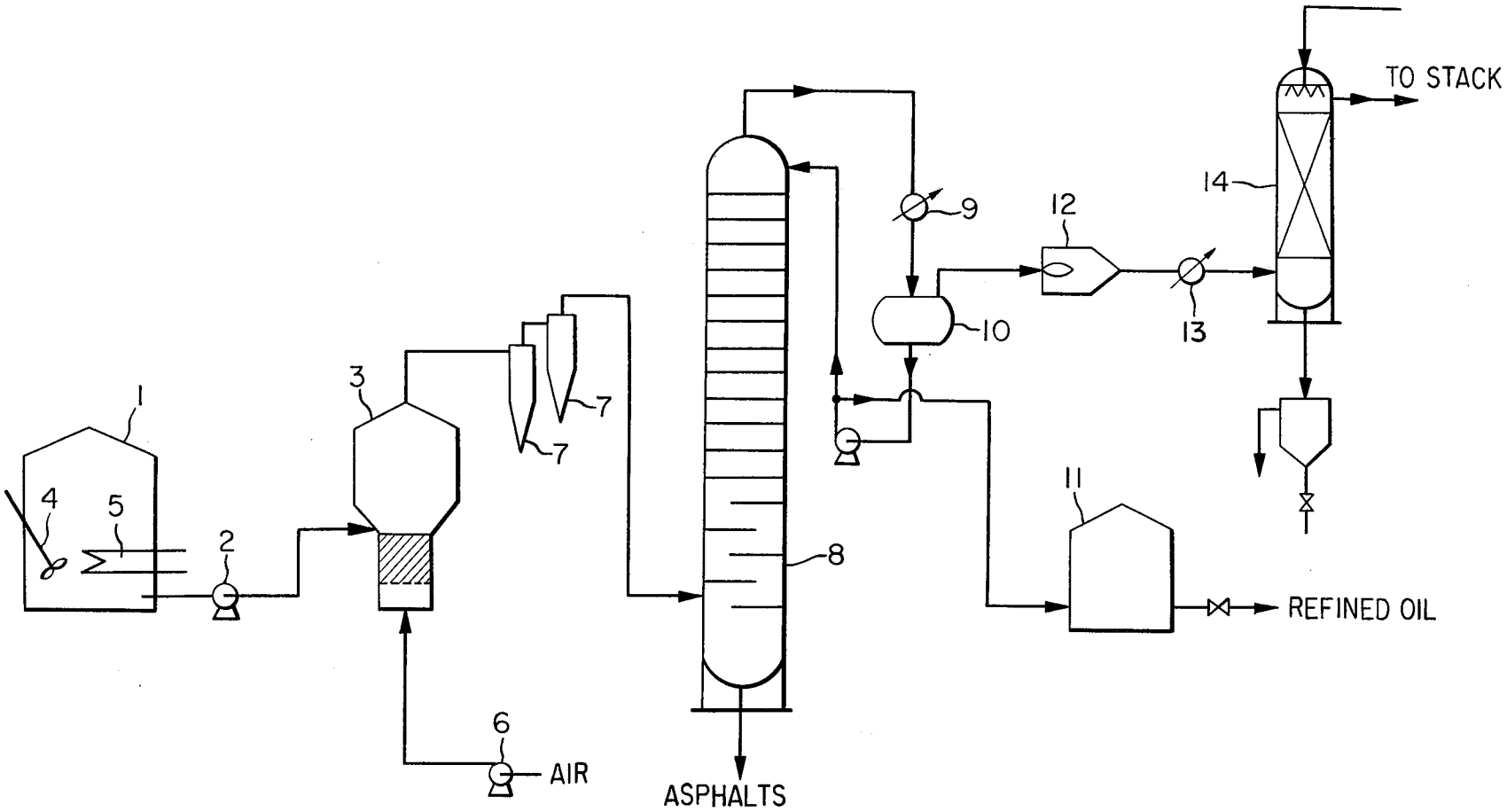
TO STACK
REFINED OIL
ASPHALTS
AIR
1
2
3
4
5
6
7
7
8
9
10
11
12
13
14

METHOD OF UPGRADING LOW-GRADE OILS

BACKGROUND OF THE INVENTION

1. Field of the Invention

The present invention relates to a method of upgrading low-grade oils, and it relates particularly to a method of recovering refined oils usable as fuel oil from low-grade contaminated oils by directly subjecting said low-grade oils to thermal cracking with a fluidized bed without resorting to any preliminary treatment.

The term 'low-grade oils' used herein means oils of low quality containing appreciable amounts of water and/or sludge, and which are definitely unusable as fuel oil as they are. To give typical examples of such oils, there are named waste oils such as used motor oil discharged from gas stations and autorepair shops, lubricating, cutting, cooling and miscellaneous oils discharged from foundries, machine shops and steel mills and the like, and waste oils from petrochemical factories, etc. The term 'low grade oil', as used herein, does not include crude oil as extracted from the earth or any refined fractions thereof. The low grade oils used in this invention contain appreciable amounts of contaminants, usually in amounts of at least 5 weight percent or more. The contaminants usually include water and/or various sludge-forming materials, including metal particles, dirt, various additives conventionally incorporated in oils to improve the properties thereof as well as various undefined materials such as low grade polymers that form in oils during use thereof. Thus, the 'low grade oil' consists of spent or waste oil products, i.e., oil products which previously have been used for various purposes or which are generated by various industrial processes, and which are no longer usable for their original intended purposes or in the industrial process concerned, because of excessive contamination and/or high viscosity thereof.

2. Description of the Prior Art

The greater part of the waste oils discharged from such various places of business as above have so far been disposed of by incineration. But, in the light of the disadvantage that the disposal of waste oils by incineration generates soot, smoke and other public nuisances, there have recently been proposed several processes for recovering fuel oil and the like from such waste oils by chemically treating the waste oils. However, all of the processes proposed heretofore require complicated pretreatment processes for separating water and/or sludge from the waste oils to begin with, and yet they fail to recover high-grade oils in amounts proportional to the complexity of the process, so that they are not always satisfactory from the viewpoint of the economics of the process. Meanwhile, the amount of waste oils is likely to increase in the future. Such being the case, development of a method suitable for recovering fuel oils from low grade oils, such as waste oil, by economically refining them without creating public nuisances is eagerly desired.

SUMMARY OF THE INVENTION

The present invention provides a method of upgrading low-grade oils which well satisfies the foregoing requirements. The method according to the present invention is especially characterized in that it renders it possible to treat low-grade oils, as they are, without resorting to any pretreatment thereof, that is, without separating therefrom the water and/or sludge contained therein. To be precise, the method of upgrading low-grade oils according to the present invention comprises the steps of introducing a low-grade oil directly into a fluidized bed type cracking furnace and subjecting it to thermal cracking therein while catching inorganic substances like metal particles of sludge forming materials, introducing the efflux from said cracking furnace into a fractionation column to separate it into a heavy component which is recovered from the bottom of said column and a light vapor component removed from the top of said column. The overhead light component is cooled and then is fed into a gas-liquid separator to separate it into a vapor-phase stream including water steam and a liquid-phase refined oil. At least a part of the refined oil is circulated to the top of the fractionation column as reflux, while the remainder is recovered as the final refined oil product.

The starting material to be treated by the method according to the present invention is, as mentioned above, those low-grade oils which are unsuitable for use as fuel oil as they are and which usually contain water and/or sludge. Mixtures of low grade oils from various sources can be used. A low-grade oil containing water in an amount up to about 20 weight percent and sludge in an amount up to about 10 weight percent can be treated by the present method without hindrance. Among these low-grade oils, the employment of the present method is particularly satisfactory for purifying and recovering a refined oil product from such waste motor oil and lubricants, waste light oil (or washing oil) and the like which are commonly discharged in large amounts from gas stations, auto repair shops, iron works, etc.

According to the present invention, a fuel oil of superior quality equivalent to the intermediate fraction between kerosene and heavy oil A can be recovered at a yield of 50 to 80 wt. % from a water and/or sludge containing low-grade oil by thermally cracking it without resorting to any particular pretreatment thereof. In this connection, according to the method of the present invention, it is possible to refine a waste oil having a blackish-brown substantially opaque color, a viscosity of 57cp (at 10° C), a specific gravity of 0.88 and a 90% distillation temperature of 385° C into a brown, translucent oil having a viscosity of 7cp, (at 10° c), a specific gravity of 0.86 and a 90% distillation temperature of 357° C. Moreover, according to the method of the present invention, a desulfurization effect is obtained; for example, by treating a waste oil containing 0.6 wt. % of sulfur, a refined oil having sulfur content of 0.48 wt. % can be obtained. In addition, the method of the present invention has the further advantage that, because the treatment of the low-grade oil is performed within a fluidized bed type cracking furnace, not only is the operation simple but also the cracking furnace per se can be of small size.

BRIEF DESCRIPTION OF THE DRAWING

The accompanying drawing is a schematic flow sheet of one embodiment of the present invention.

DESCRIPTION OF THE PREFERRED EMBODIMENT

In the following there will be given full particulars of the method according to the present invention with reference to a flow sheet illustrative of one embodiment thereof.

The low-grade oil stored in the waste oil storage tank 1 is supplied to the fluidized bed type cracking furnace 3 via a pump 2. It is desirable that the waste oil storage tank 1 is provided with a stirrer 4 and a heater 5 therein to cause the water and/or sludge contained in said waste oil to be uniformly dispersed therein in advance. Within the fluidized bed type cracking furnace 3, there is provided a fluidized medium consisting essentially of siliceous sand having a mean grain size or particle diameter of about 200 $\mu$. The particles are continuously maintained in the state of a flowing fluidized bed condition and are simultaneously maintained at a temperature of 400° to 500° C by blowing in preheated air supplied by the blower 6, so that the waste oil supplied to the cracking furnace is thermally cracked and they are maintained at atmospheric pressure in condition of SV (space velocity) 0.6 $\approx$ 1.0 [1/H]. The resulting thermally cracked product is taken out of the top of the cracking furnace as a vapor phase stream. This stream is flowed into one or more cyclones 7 to separate sand and other solid particles therefrom and these particles are recycled to the furnace 3 or discarded as desired. The vapor phase stream is then introduced into the lower part of a fractionation column 8 at temperature of about 350°C wherein it is fractionated into a heavy component recovered as bottoms and a light component recovered as distillate. The heavy component contains asphalt, carbon. sand and the like. It descends to the bottom of said column and is removed therefrom. The light component is taken out of the top of the column 8 at temperature of about 150°C, is passed through a condenser 9 to condense the oil therein and then is sent into a gas-liquid separator 10. In this gas-liquid separator 10, a refined oil is separated from the remaining noncondensed vapor phase component at conditions of 50°C and 1 atm. At these conditions water is not condensed since the water vapor pressure is lower than its saturated vapor pressure. A part of the thus separated refined oil is recirculated to the top of the distillation column as reflux (reflux ratio : 1.2 to 1.5), while the remainder of the oil is fed into the refined oil storage tank 11 as the final product of the process. This resultant product includes little sludge and water, and has a viscosity of 2.0 to 9.0 cp equivalent to that of kerosene or gas oil.

The heavy component separated at the bottom of the column 8 may be recirculated to the cracking furnace 3 if desired.

The noncondensed vapor phase separated in the gas-liquid separator 10 is fed to a gas incinerator 12 and is burned therein. The combustion products are flowed through a heat exchanger 13 for the purpose of recovering the resulting combustion heat. Then the combustion gases are fed into a stripping column 14 wherein they are contacted by a stripping fluid such as water for the purpose of removing harmful substances like $SO_2$ or HCl contained therein. The purified gas is thereafter discharged to the outside of the system.

What is claimed is:

1. A method of recovering a refined oil from waste oil containing substantial amounts of water and sludge which comprises the steps of introducing the waste oil directly into a fluidized bed type cracking furnace and subjecting it to thermal cracking therein, introducing the resulting gaseous efflux from said cracking furnace into a fractionation column to separate it into a water containing light vapor component as distillate and a heavy component at the bottom of said column, cooling the light vapor component to a temperature above the dew point of the water present therein and then feeding it into a gas-liquid separator to divide it into a vapor phase stream and a liquid phase refined oil, and circulating at least a portion of said refined oil to the top of the fractionation column as the reflux while recovering the rest as the final product, and feeding said vapor phase stream to a gas incinerator and burning it therein.

2. A method according to claim 1, wherein said waste oil contains water to the extent of 20 wt.% and sludge to the extent of 10 wt. %.

3. A method according to claim 1, wherein said thermal cracking of waste oil within the fluidized bed type cracking furnace is effected at a temperature in the range of 400° to 500° C, utilizing a fluidized bed of siliceous sand having a mean grain size of about 200$\mu$.

4. A method as claimed in claim 1, in which said waste oil is selected from the group consisting of used motor oil and waste lubricating, cutting, cooling and miscellaneous oils from foundries, machine shops, steel mills and the like, and waste oils from petrochemical factories, said waste oil containing at least 5 weight percent of water and sludge, said waste oil is introduced at a space velocity of from 0.6 to 1.0/hr. directly into said cracking furnace, at atmospheric pressure, containing a fluidized bed of sand particles therein having a temperature of 400° to 500° so that said waste oil is thermally cracked therein to produce said gaseous efflux, separating solid particles from said gaseous efflux and then introducing the remainder of said gaseous efflux at a temperature of about 350°C into the lower part of said fractionation column and fractionating same therein to recover said heavy component as the bottoms and said light vapor component as the overhead at a temperature of about 150°C and containing the refined oil and substances of lower boiling point, in said cooling step condensing the refined oil in said overhead light vapor component to obtain a gas-liquid mixture, in said gas-liquid separator separating said liquid phase condensed refined oil from said vapor phase stream at a temperature of about 50°C and a pressure of one atmosphere so that water is not condensed, feeding said portion of the condensed refined oil to the top of said fractionation column as reflux so as to maintain a reflux ratio of 1.2 to 1.5, recovering the remainder of the condensed refined oil as a final refined oil product which is substantially free of sludge and water and has a viscosity of 2.0 to 9.0 centipoise, feeding said vapor phase stream to said gas incinerator and burning same therein, scrubbing the gaseous products of combustion emitted from said incinerator and then discharging same.

5. A method as claimed in claim 1, in which said waste oil is selected from the group consisting of used motor oil and waste lubricating, cutting, cooling and miscellaneous oils from foundries, machine shops, steel mills and the like, and waste oils from petrochemical factories, said waste oil containing at least 5 weight percent of water and sludge, said waste oil is introduced directly into said cracking furnace containing a fluidized bed of sand particles therein having a temperature effective to thermally crack said waste oil therein, to produce said gaseous efflux, introducing said gaseous efflux into the lower part of said fractionation column and fractionating same therein to recover said heavy component as the bottoms and said light vapor component as the overhead containing the refined oil and substances of lower boiling point, in said cooling step condensing the refined oil in said overhead light vapor component to obtain a gas-liquid mixture, in said gas-liquid separator separating said liquid phase condensed refined oil from said vapor phase stream at a temperature effective to maintain the water in the vapor phase, feeding said portion of the condensed refined oil to the top of said fractionation column as reflux, recovering the remainder of the condensed refined oil as a final refined oil product which is substantially free of sludge and water and which is suitable for use as a fuel oil, feeding said vapor phase stream to said gas incinerator and burning same therein.

* * * * *